US005990430A

United States Patent [19]

Shiau

[11] Patent Number: 5,990,430

[45] Date of Patent: Nov. 23, 1999

[54] WATERPROOF SWITCH DEVICE FOR A FLASHLIGHT

[76] Inventor: Shoei-Shuh Shiau, No. 10, Alley 1, Lane 551, Sec. 1, Wan-Shou Rd. Guei-Shan, Hsiang, Tao-Yuan Hsien, Taiwan

[21] Appl. No.: 09/190,063

[22] Filed: Nov. 12, 1998

[51] Int. Cl.[6] ..... H01H 13/06

[52] U.S. Cl. ..... 200/302.2; 200/60

[58] Field of Search ..... 200/302.2, 60; 362/206

[56] References Cited

U.S. PATENT DOCUMENTS

| | | | |
|---|---|---|---|
| Re. 29,047 | 11/1976 | Brindley | 200/60 X |
| 5,211,471 | 5/1993 | Rohrs | 362/206 |
| 5,752,764 | 5/1998 | Shiau | 362/206 |

*Primary Examiner*—Renee S. Luebke
*Attorney, Agent, or Firm*—Foley & Lardner

[57] ABSTRACT

A switch device is mounted on the rear end of a conductive barrel body of a flashlight, and includes an actuating plunger movably disposed in a coupling member. An elastomeric cap member includes an annular insert portion interposed between a rear annular wall of the coupling member and the actuating plunger, and a cap portion. The cap portion has a depressible body and an annular connecting portion which extends forwardly in an axial direction and which is formed integrally with the insert portion to define an annular juncture therebetween. A block member extends radially and outwardly from the annular juncture to form a shoulder that faces rearwards, and has an outer peripheral surface distal to and radially spaced relative to the annular juncture. A socket portion extends forwardly from the depressible body so as to be plugged by a depressible plug end of the actuating plunger. A tubular retaining member includes an inner annular retaining portion that extends inwardly and radially from an inner surface thereof such that, once the retaining member is brought to engage the rear annular wall of the coupling member, liquid-tight abutments are established among the inner annular retaining portion and the annular connecting portion and the shoulder.

3 Claims, 6 Drawing Sheets

WATERPROOF SWITCH DEVICE FOR A FLASHLIGHT

BACKGROUND OF THE INVENTION

1. Field of the Invention

The invention relates to a flashlight, more particularly to a flashlight having a waterproof switch device mounted on a rear end thereof.

2. Description of the Related Art

FIGS. 1 and 2 illustrate a flashlight disclosed in U.S. Pat. No. 5,752,764. As shown, a barrel body 8 has a front annular end 81 and a rear annular end 82 in a longitudinal direction, and a battery (not shown) received in the barrel body 8 such that an electrode thereof is proximate to the rear annular end 82. A switch device is mounted on the rear annular end 82 for switching on and off a bulb 83 mounted at the front annular end 81. The switch device includes a conductive coupling member 20, a conductive spring member 25, an insulative first retaining member 26, a contact member 24, an actuating plunger 21, a second retaining member 22, and a cap member 23. The coupling member 20 has a front annular wall 201 adapted to be moved in the longitudinal direction relative to the rear annular end 82 of the barrel body 8 and adapted to engage the rear annular end 82 to establish an electric connection therebetween, a rear annular wall 202, and a middle annular portion interposed between the front and rear annular walls 201, 202. The spring member 25 is retained in the coupling member 20 and is insulated therefrom by the first retaining member 26 in such a manner that a front section 251 thereof extends outwardly of the coupling member 20 so as to be brought into contact with the electrode. The contact member 24 is sleeved around the second retaining member 22, and the assembly of the members 22, 24 is disposed in the middle portion of the coupling member 20 such that contact ends 241 of the contact member 24 are located proximate to a rear section 252 of the spring member 25. The actuating plunger 21 is disposed to be movable relative to the coupling member 20 in an axial direction, and has a front actuating portion 212 secured to the rear section 252 of the spring member 25 to electrically connect and disconnect the contact ends 241 to and from the rear section 252, and a depressible portion 211 that extends rearwardly and outwardly of the second retaining member 22. The cap member 23 includes a cap portion 230 mounted on the rear annular end 202 of the coupling member 20, and has a socket portion 232 that extends forwardly in the axial direction so as to be plugged therein by the depressible portion 211 of the actuating plunger 21.

Some of the disadvantages of the aforesaid conventional switch device are as follows:

The second retaining member 22 is retained in the coupling member 20 by virtue of friction force that is applied by a ring 235, and the depressible portion 211 extends through the second retaining member 22. Thus, sliding movement of the depressible portion 211 may eventually result in disengagement of the ring 235 and the second retaining member 22 relative to the coupling member 20 after long term use.

An annular clearance is formed between the cap portion 230 and the rear annular end 202 of the coupling member 30 after the assembly, thereby resulting in poor waterproof effect for the conventional switch device.

SUMMARY OF THE INVENTION

Therefore, the object of this invention is to provide a waterproof switch device for a flashlight which is clear of the disadvantages mentioned beforehand.

Accordingly, the waterproof switch device of this invention is employed in a flashlight which includes a conductive barrel body having a front annular end portion and a rear annular end portion in a longitudinal direction, and a battery received in the barrel body with an electrode proximate to the rear annular end portion. The waterproof switch device includes a conductive coupling member, a conductive spring member, an insulated retaining member, a contact member, an actuating plunger, an elastomeric cap member, and a conductive retaining member. The coupling member has a front annular wall adapted to be moved in the longitudinal direction relative to the rear annular end portion of the barrel body and adapted to engage the rear annular end portion to establish an electric connection therebetween, a rear annular wall, and a middle annular portion interposed between the front and rear annular walls in an axial direction parallel to the longitudinal direction. The conductive spring member is disposed in the coupling member, and has a front section that extends outwardly of the front annular wall and that is adapted to be brought into contact the electrode. The spring member further has a middle section, and a rear section in the axial direction. The insulated retaining member is disposed in the coupling member to hinder movement of the middle section of the spring member in the axial direction relative to the coupling member and to insulate electrically the spring member from the coupling member. The contact member is disposed to be in electric contact with the coupling member, and has a contact end proximate to the rear section of the spring member. The actuating plunger is disposed to be movable relative to the coupling member in the axial direction, and has a front actuating end that is secured to the rear section of the spring member to electrically connect and disconnect the contact end of the contact member to and from the rear section when the actuating plunger is moved in the axial direction between switch-on and switch-off positions. The actuating plunger further has a depressible plug end extending rearwardly and outwardly of the rear annular wall of the coupling member. The elastomeric cap member includes an annular insert portion interposed between the rear annular wall and the actuating plunger and extending in the axial direction, and a cap portion. The cap portion has a depressible body and an annular connecting portion which extends forwardly from the periphery of the cap portion in the axial direction and which is formed integrally with the insert portion to define an annular juncture therebetween. An annular block member extends radially and outwardly from the annular juncture to form a shoulder that faces rearwardly in the axial direction. The block member has an outer peripheral surface distal to and radially spaced relative to the annular juncture. A socket portion is disposed to extend forwardly from the depressing body in the axial direction so as to be plugged by the depressible plug end of the actuating plunger. The conductive retaining member has a forward annular engaging end disposed to be fitted snugly with the rear annular wall once the conductive retaining member is brought towards the coupling member in the axial direction. An annular engaging portion extends rearwardly from the forward annular engaging end in the axial direction, and has a forward inner wall proximate to the forward annular engaging end and of a first dimension sufficient to engage fittingly the outer peripheral surface of the block member when the forward annular engaging end is fitted snugly on the rear annular wall. The conductive retaining member further has an inner annular retaining portion that extends inwardly and radially from the forward inner wall, and that is spaced from the forward annular engaging end in the axial direction. The inner annular retaining portion is of a second dimension less than that of an outer circumference of the annular connecting portion that is proximate to the annular juncture so as to form liquid-tight abutments among the inner annular retaining portion, the annular connecting portion and the shoulder when the conductive retaining member is brought to fit snugly with the rear annular wall.

BRIEF DESCRIPTION OF THE DRAWINGS

Other features and advantages of this invention will become more apparent in the following detailed description of the preferred embodiment of this invention, with reference to the accompanying drawings, in which.

DETAILED DESCRIPTION OF THE PREFERRED EMBODIMENT

Figure 1:
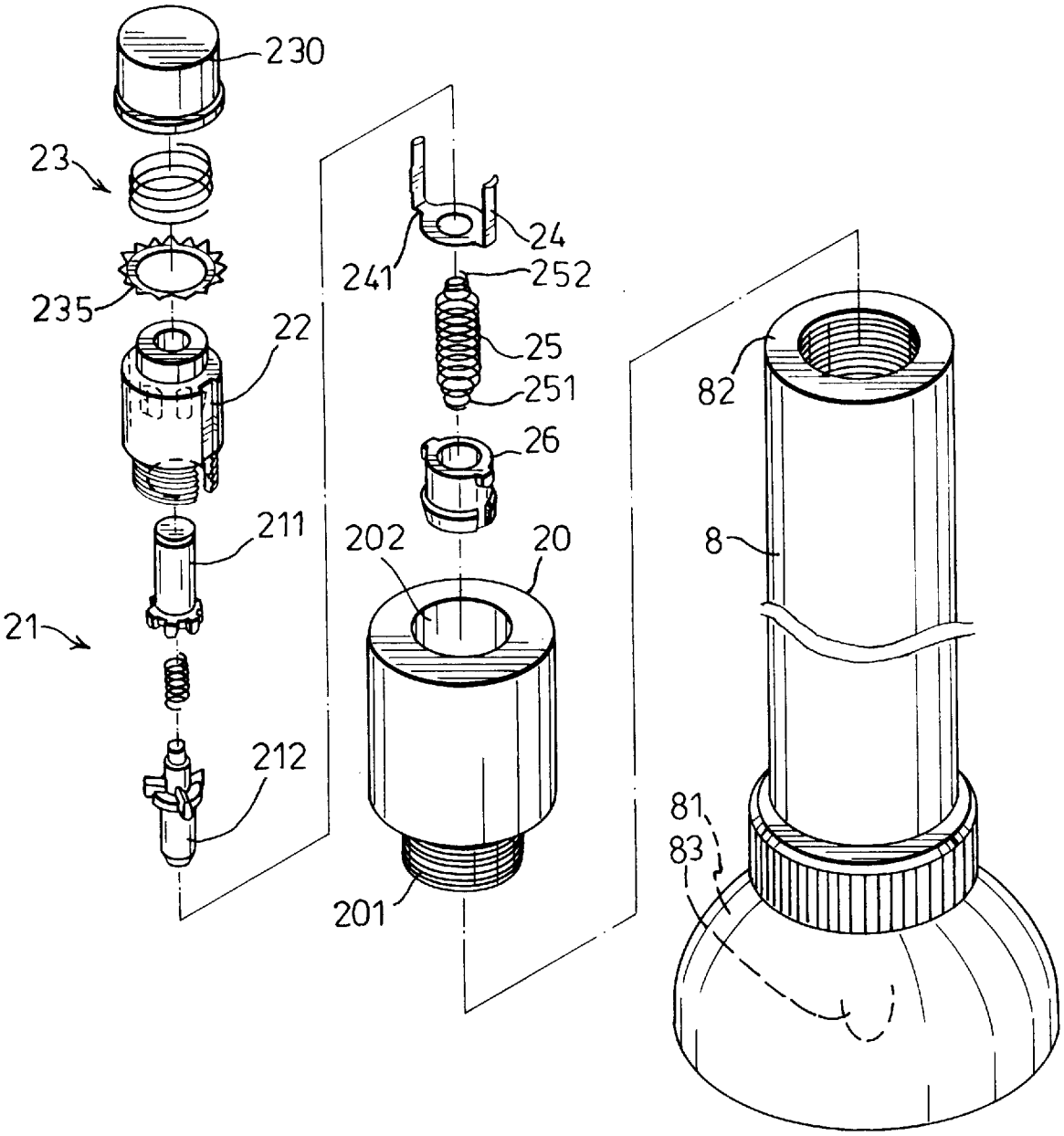
FIG. 1 PRIOR ART
FIG. 1 is an exploded view of a flashlight disclosed in U.S. Pat. No. 5,752,764.
Figure 2:
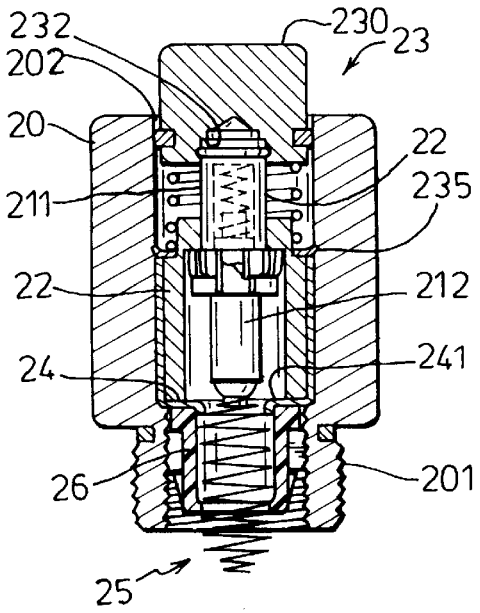
FIG.2 PRIOR ART
FIG. 2 is a fragmentary sectional view of a switch device employed in the flashlight of FIG. 1.

Referring to FIGS. 3, 4, 5 and 6, the preferred embodiment of a waterproof switch device of this invention is to be employed in a flashlight which includes a conductive barrel body 140 having a front annular end portion 141 with a light bulb 142, a rear annular end portion 143 in a longitudinal direction, and a battery 145 received in the barrel body 140 with an electrode proximate to the rear annular end portion 143. The switch device includes a coupling member 3, a conductive spring member 41, an insulated retaining member 46, a contact member 42, an actuating plunger 4, an elastomeric cap member 6, and a conductive retaining member 5.

As illustrated, the coupling member 3 has a front annular wall 32 adapted to be moved in the longitudinal direction relative to the rear annular end portion 143 and adapted to engage the rear annular end portion 143 to establish an electric connection therebetween, a rear annular wall 31, and a middle annular portion 30 interposed between the front and rear annular walls 32, 31 in an axial direction parallel to the longitudinal direction.

The conductive spring member 41 is disposed in the coupling member 3, and has front section 411 extending outwardly of the front annular wall 32 (see FIG. 6) and adapted to be brought into contact with the electrode, a middle section 412, and a rear section 413 in the axial direction.

The insulated retaining member 46 is disposed in the coupling member 3 to hinder movement of the middle section 412 of the spring member 41 in the axial direction relative to the coupling member 3 and to insulate electrically the spring member 41 from the coupling member 3.

The contact member 42 is disposed to be in electric contact with the coupling member 3, and has a contact end 421 proximate to the rear section 413 of the spring member 41.

The actuating plunger 4 is disposed to be movable relative to the coupling member 3 in the axial direction, and has a front actuating end 45 secured to the rear section 413 of the spring member 41 to electrically connect and disconnect the contact end 421 of the contact member 42 to and from the rear section 413 of the spring member 41 when the actuating plunger 4 is moved in the axial direction between switch-on and switch-off positions. The actuating plunger 4 further has a depressible plug end 40 that extends rearwardly and outwardly of the rear annular wall 31 of the coupling member 3.

The cap member 6 includes an annular insert portion 64 that is interposed between the rear annular wall 31 of the coupling member 3 and the actuating plunger 4 and that extends in the axial direction, and a cap portion 65 which has a depressible body 65A and an annular connecting portion 63 that extends forwardly from the periphery of the cap portion 65 in the axial direction. The annular portion 63 is formed integrally with the insert portion 64 to form an annular juncture 66 therebetween. An annular block member 61 extends radially and outwardly from the annular juncture 66 to form a shoulder 61A that faces rearwardly in the axial direction. The block member 61 has an outer peripheral surface 61B distal to and radially spaced relative to the annular juncture 66. A socket portion 67 is disposed to extend from the depressible body 65A forwards in the axial direction so as to be plugged therein by the depressing plug end 40 of the actuating plunger 4.

The retaining member 5 has a forward annular engaging end 50 disposed to be fitted snugly with the rear annular wall 31 of the coupling member 3 once the retaining member 5 is brought towards the coupling member 3 in the axial direction, and an annular engaging portion 52 that extends rearwardly from the forward annular engaging end 50 in the axial direction. The engaging portion 52 has a forward inner wall 52I proximate to the forward annular engaging end 50 and of a dimension sufficient to engage fittingly the outer peripheral surface 61B of the block member 61 when the forward annular engaging end 50 is fitted snugly on the rear annular wall 31. An inner annular retaining portion 51 extends inwardly and radially from the forward inner wall 52I, and is spaced from the forward annular engaging end 50 in the axial direction. The inner annular retaining portion 51 is of a dimension less than that of an outer circumference of the annular connecting portion 63 that is proximate to the annular juncture 66 so as to form liquid-tight abutments between the inner annular retaining portion 51 and the annular connecting portion 63, and between the inner annular retaining portion 51 and the shoulder 61A, when the retaining member 5 is brought to fit snugly with the rear annular wall 31 of the coupling member 3 against frictional force that is generated between the outer circumference of the annular connecting portion 63 and the inner annular retaining portion 51 of the retaining member 5.

Note that the front actuating end 45 and the depressible plug end 40 of the actuating plunger 4, and the first retaining member 46 are similar to the constructions disclosed in the aforesaid U.S. Patent. As such, movement of the actuating plunger 4 in the coupling member 3 results in switching on and switching off of the light bulb 142. Since the features of this invention are not directly concerned with the actuating plunger 4, a detailed description thereof is omitted herein for the sake of brevity.

Figure 3:
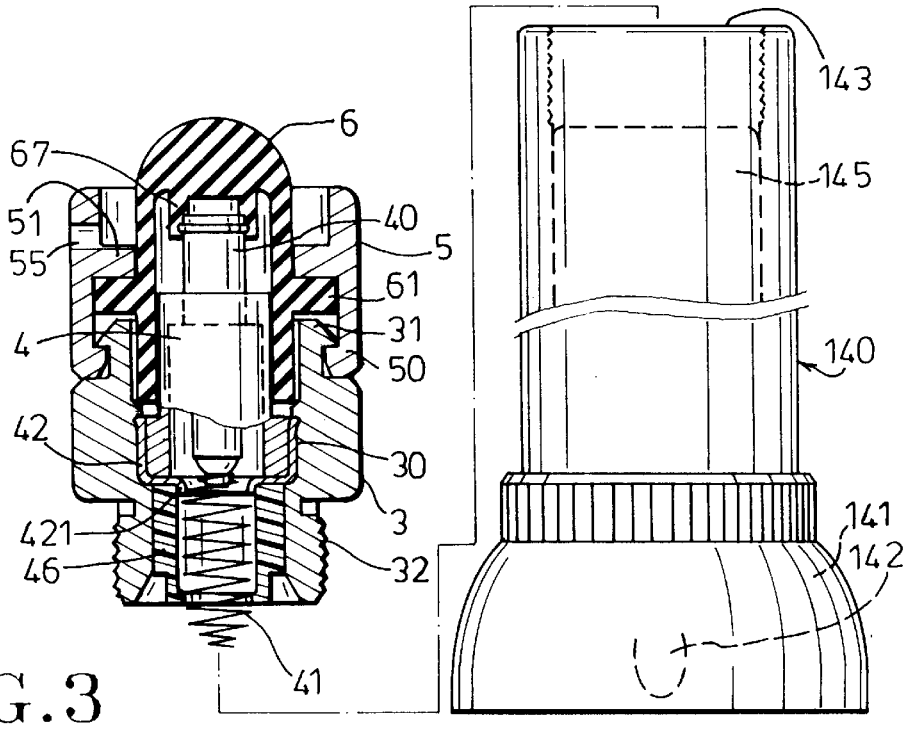
FIG. 3 is a fragmentary, sectional and exploded view of a flashlight, in which a waterproof switch device of this invention is employed.
Figure 4:
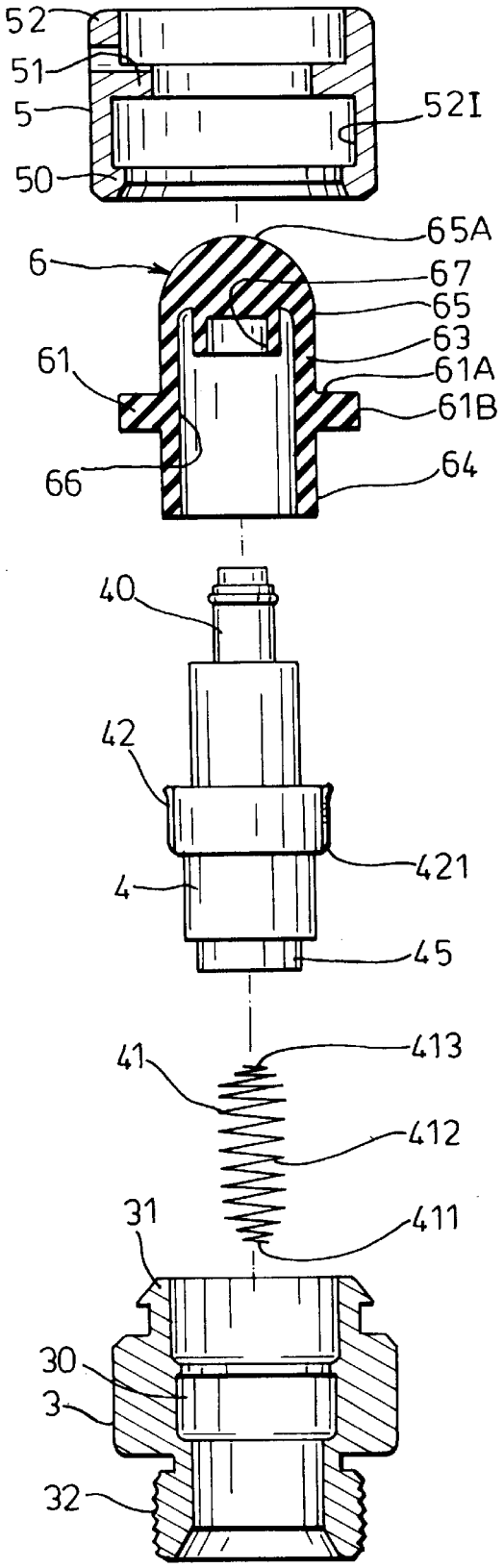
FIG. 4 is a fragmentary, sectional and exploded view of the waterproof switch device of this invention.
Figure 5:
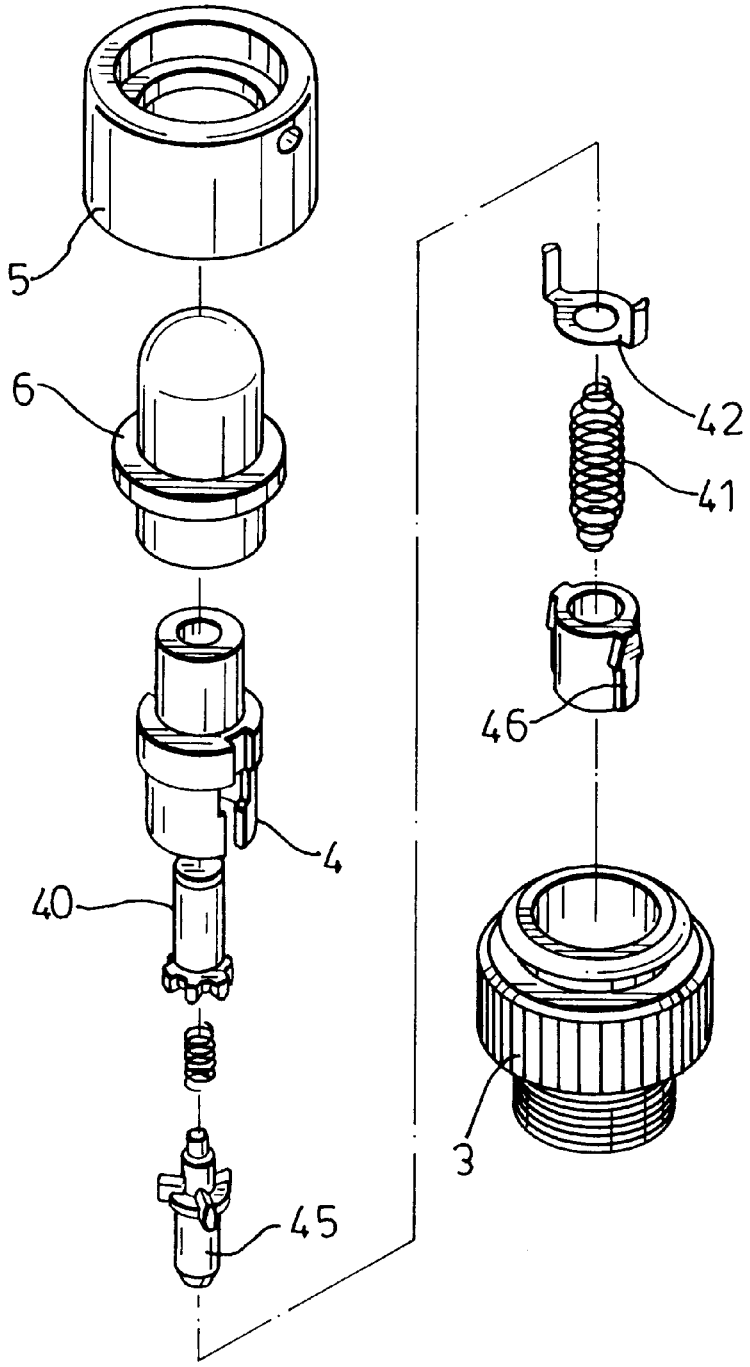
FIG. 5 is an exploded perspective view of the waterproof switch device of this invention.
Figure 6:
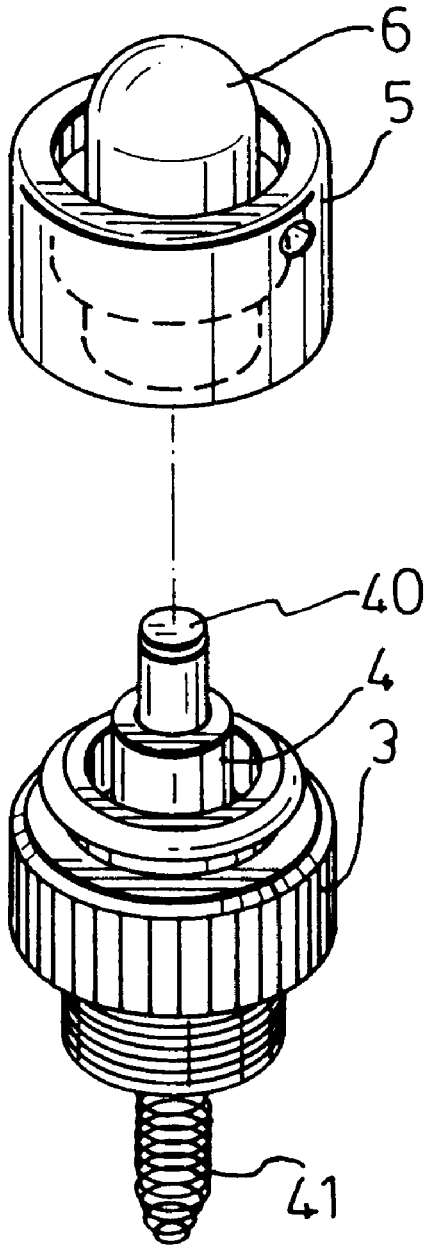
FIG. 6 is a partly exploded view of the waterproof switch device of this invention.
Figure 7:
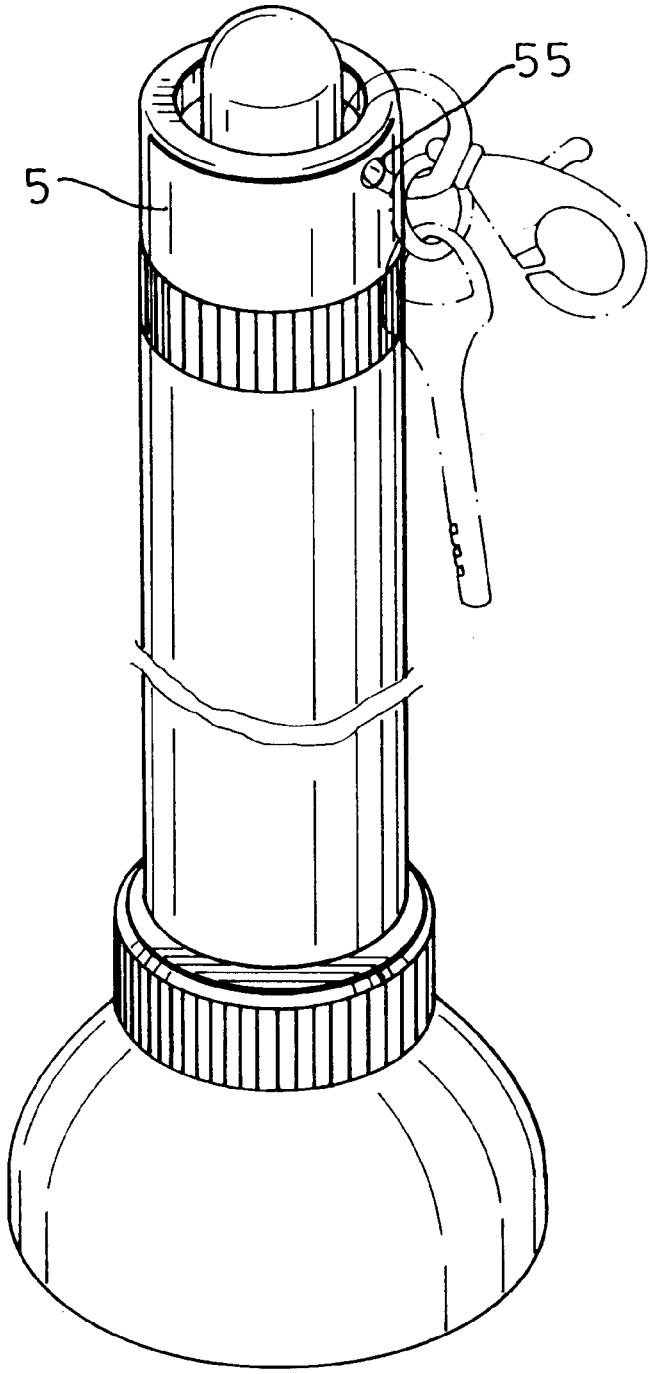
FIG. 7 is a perspective view of a flashlight equipped with the waterproof switch device of this invention.

Referring to FIGS. 3 and 7, the retaining member 5 is preferably provided with a radial hole 55 such that a retainer hook can be fixed thereto to facilitate holding of the flashlight that is employed with the waterproof switch device of this invention.

With this invention thus explained, it is apparent that numerous modifications and variations can be made without departing from the scope and spirit of this invention. It is therefore intended that this invention be limited only as indicated in the appended claims.

I claim:

1. A waterproof switch device for a flashlight which includes a conductive barrel body having a front annular end portion and a rear annular end portion in a longitudinal direction, and a battery received in the barrel body with an electrode proximate to the rear annular end portion, said waterproof switch device comprising:

a conductive coupling member having a front annular wall adapted to be moved in the longitudinal direction relative to and adapted to engage the rear annular end portion to establish an electric connection therebetween;

a rear annular wall; and a middle annular portion interposed between said front and rear annular walls in an axial direction parallel to the longitudinal direction;

a conductive spring member disposed in said coupling member;

an elastomeric cap member including an annular insert portion extending in said axial direction, a cap portion having a depressible body with a periphery, and an annular connecting portion that extends forwardly from said periphery in said axial direction and that is formed integrally with said insert portion to form an annular juncture therebetween, an annular block member extending radially and outwardly from said annular juncture to form a shoulder facing rearwardly in said axial direction, said block member having an outer peripheral surface distal to and radially spaced relative to said annular juncture, and a conductive retaining member having a forward annular engaging end disposed to be fitted snugly with said rear annular wall once said retaining member is brought towards said coupling member in said axial direction, an annular engaging portion extending rearwardly from said forward annular engaging end in said axial direction, and having a forward inner wall proximate to said forward annular engaging end and of a first dimension sufficient to engage fittingly said outer peripheral surface of said block member when said forward annular engaging end is fitted snugly on said rear annular wall, and an inner annular retaining portion inwardly and radially extending from said forward inner wall, and spaced from said forward annular engaging end in said axial direction, said inner annular retaining portion being of a second dimension less than that of an outer circumference of said annular connecting portion that is proximate to said annular juncture so as to form liquid-tight abutments among said inner annular retaining portion, said annular connecting portion and said shoulder when said retaining member is brought to fit snugly with said rear annular wall of said coupling member.

2. The waterproof switch device as defined in claim 1, wherein said spring member has a middle section and a rear section in said axial direction, said switch device further comprising an insulated retaining member disposed in said coupling member to hinder movement of said middle section of said spring member in said axial direction relative to said coupling member and insulate electrically said spring member from said coupling member;

a contact member disposed to be in electric contact with said coupling member, and having a contact end proximate to said rear section of said spring member;

an actuating plunger disposed to be movable relative to said coupling member in said axial direction, and having a front actuating end secured to said rear section of said spring member to electrically connect and disconnect said contact end of said contact member to and from said rear section when said actuating plunger is moved in said axial direction between switch-on and switch-off positions, and a depressible plug end extending rearwardly and outwardly of said rear annular wall of said coupling member.

3. The waterproof switch device as defined in claim 2, wherein said cap member further has a socket portion disposed to extend forwardly from said depressible body in said axial direction so as to be plugged therein by said depressible plug end.

* * * * *